US007902901B1

(12) United States Patent
Roger

(10) Patent No.: US 7,902,901 B1
(45) Date of Patent: Mar. 8, 2011

(54) RF SQUARER

(75) Inventor: Frederic Roger, Santa Clara, CA (US)

(73) Assignee: Scintera Networks, Inc., Sunnyvale, CA (US)

( * ) Notice: Subject to any disclaimer, the term of this patent is extended or adjusted under 35 U.S.C. 154(b) by 114 days.

(21) Appl. No.: 12/340,111

(22) Filed: Dec. 19, 2008

(51) Int. Cl.
*G06G 7/20* (2006.01)

(52) U.S. Cl. ..... 327/349; 327/346; 327/355; 327/356; 708/835; 455/130; 455/307

(58) Field of Classification Search ..... 327/346, 327/349, 355, 356; 708/835, 837, 277, 851; 455/130, 307, 257
See application file for complete search history.

(56) References Cited

U.S. PATENT DOCUMENTS

| | | | | |
|---|---|---|---|---|
| 7,139,544 | B2 * | 11/2006 | Smith et al. | 455/307 |
| 7,266,351 | B2 * | 9/2007 | Marholev | 455/130 |
| 2009/0131006 | A1 * | 5/2009 | Wu | 455/257 |

* cited by examiner

*Primary Examiner* — Lincoln Donovan
*Assistant Examiner* — Shikha Goyal
(74) *Attorney, Agent, or Firm* — Haynes and Boone, LLP.

(57) ABSTRACT

An RF squarer circuit comprises a first RF multiplier and a first variable gain transimpedance amplifier (TIA). The first RF multiplier receives an RF input signal RFIN and provides a first output current. The first TIA receives the first output current as an input. The first TIA provides an output voltage VOUT.

20 Claims, 2 Drawing Sheets

$$(A \cdot Cos(\omega))^2 = \frac{A^2}{2}(1 + Cos(2\omega))$$

RF SQUARER

CROSS REFERENCE TO RELATED APPLICATIONS

The present patent application is related to copending U.S. patent applications (the "Copending Applications"): (a) Ser. No. 12/037,455, entitled "High Order Harmonics Generator," which names as inventor Frederic Roger, and was filed on Feb. 26, 2008; (b) Ser. No. 12/257,292, entitled "Error Signal Formation for Linearization," which names as inventor Adric Q. Broadwell and others, and was filed on Oct. 23, 2008 and (c) Ser. No. 12/340,032, entitled "Integrated Signal Analyzer for Adaptive Control of Mixed-Signal Integrated Circuits," which names as inventor Qian Yu and others, and was filed on the same day as the present invention. The Copending Applications are hereby incorporated by reference in their entireties.

TECHNICAL FIELD

The present invention relates generally to an RF Squarer and particularly to an RF Squarer having relatively constant gain over process, voltage and temperature (PVT).

BACKGROUND

RF squarer circuits require a certain amount of gain, for example a significant amount of gain. For example, if the input signal has an amplitude A<1V (as may be typical in the case of modern integrated circuits), its power of two ($A^2$) is a signal that is about an order of magnitude smaller than A:

e.g., where A=100 mV; $A^2$=10 mV.

A high gain can be achieved using a cascade of amplification stages with the drawback that each stage requires power and generates noise. For low noise applications, the number of active devices used may be reduced.

High gain can be achieved with a TIA by increasing the resistance of feedback resistors. However, increasing the gain reduces the bandwidth at the same time, due to a pole created together with parasitic capacitances. In addition, the gain achieved by an RF squarer may vary significantly over process, voltage and temperature (PVT). In some applications, a variation of up to at least 10 dB may be expected. Accordingly, there is a need for an RF Squarer with relatively high gain while reducing bandwidth loss.

SUMMARY

An RF squarer circuit may include an RF multiplier and a variable gain transimpedance amplifier (TIA). The RF multiplier receives an RF input signal RFIN and provides an output current. The TIA receives the output current as an input and provides an output voltage VOUT.

An RF squarer circuit according to example embodiments of the present disclosure may provide relatively high gain and with relatively high output bandwidth, for example a few hundred MHz. An RF squarer circuit according to example embodiments of the present disclosure may provide relatively stable or constant gain over process, voltage and temperature (PVT). An RF squarer circuit according example embodiments of the present disclosure may be suitable for use in a power detector.

DESCRIPTION OF THE DRAWINGS

It should be appreciated that like reference numerals are used to identify like elements illustrated in one or more of the figures.

DETAILED DESCRIPTION

The following discussion is directed to embodiments of RF squarer circuits. However, it will be appreciated that the subject matter of the disclosure may apply to other embodiments.

Figure 1:
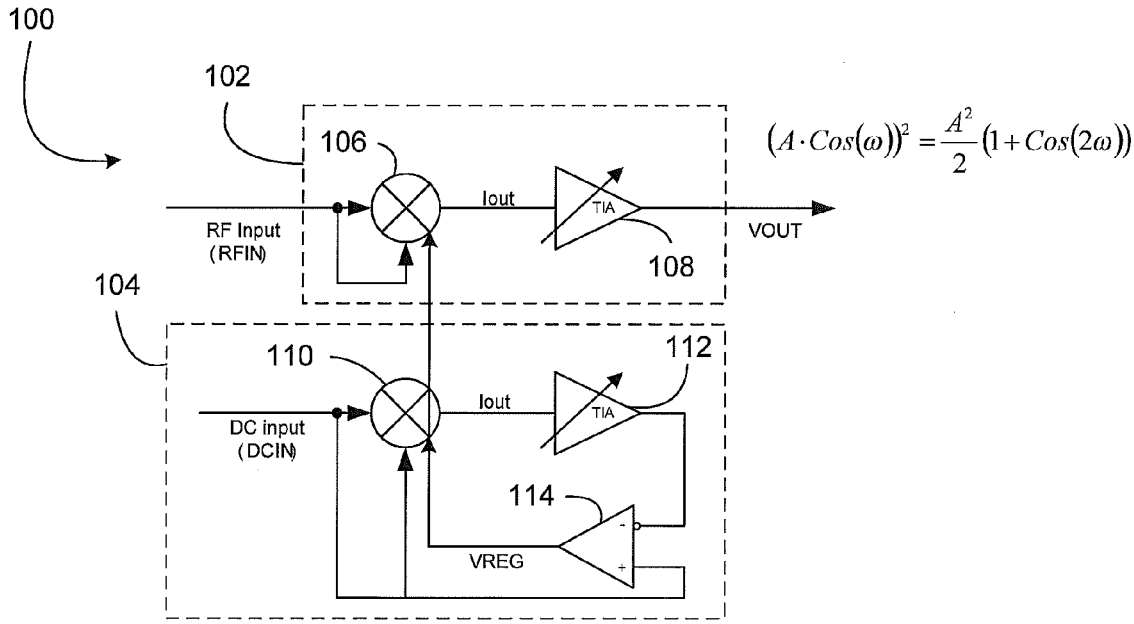
FIG. 1 illustrates an example embodiment of an RF squarer.

FIG. 1 illustrates an example embodiment of an RF squarer circuit 100. RF squarer circuit 100 may include an RF multiplier 106 and a variable gain transimpedance amplifier (TIA) 108. The RF multiplier 106 may be a current-mode or current output RF multiplier and may feed TIA 108 with an output current. The TIA 108 may have a cascade of two stages of transconductance amplifiers. Example embodiments of a suitable TIA 108 are discussed below, with respect to FIG. 2. Example embodiments of a suitable RF multiplier 106 are discussed below with respect to FIG. 3.

In an example embodiment, RF squarer 100 may achieve a "high gain" or relatively high gain using a cascade of amplification stages, for example up to at least about 20 dB, and may be suitable for use in any frequency range. In an example embodiment, it may be used in the Gigahertz range. The desired gain, for example "high gain," may be achieved using a two-stage transimpedance amplifier (TIA). The second stage of the TIA may add some peaking in the transfer function, which may extend the bandwidth of the RF squarer output. Using a cascade of two Gm amplification stages may induce peaking in the transfer function in order to increase the bandwidth of RF squarer circuit 100. The RF squarer circuit 100 may generate a signal VOUT. The signal VOUT may be proportional to the power of an RF input signal RFIN. For example, the RF squarer circuit may generate the signal VOUT according to the equation:

$$(A \cdot \mathrm{Cos}(\omega))^2 = \frac{A^2}{2}(1 + \mathrm{Cos}(2\omega))$$

RF squarer 100 may have relatively low output impedance due to loop gain. The VOUT may drive a relatively low impedance load. The output impedance may be, for example, in the 20 Ohm range. The output impedance may be higher or lower if desired.

Figure 3:
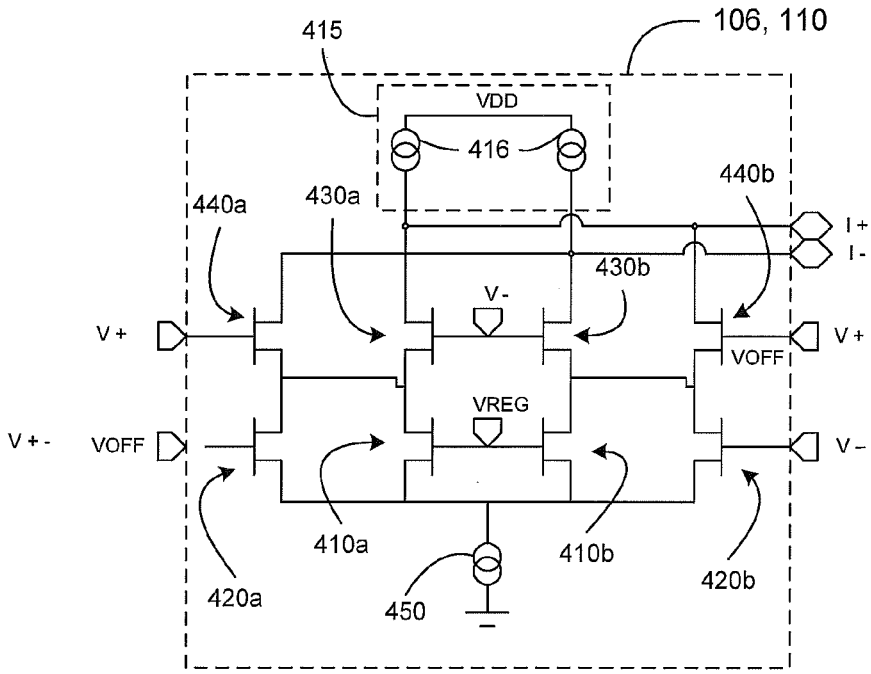
FIG. 3 illustrates an example embodiment of a current mode, analog multiplier with gain control.

In an example embodiment, RF squarer circuit 100 may include main path 102 and replica path 104. The main path 102 may include RF multiplier 106 and a variable gain transimpedance amplifier (TIA) 108 as discussed above. The RF squarer circuit may also include a replica path 104. Replica path 104 may include an RF multiplier 110 and a variable gain transimpedance amplifier (TIA) 112. Replica path 104 may further include a voltage controlled regulation amplifier 114. Replica path 104 may generate a voltage output VREG to control the gain of RF multiplier 106. The gain of multiplier 106 may be regulated using a degeneration transistor in parallel with a signal transistor 420*a*, 420*b*, as shown in FIG. 3.

Referring again to FIG. 1, in an example embodiment, the replica path 104 operates to control the gain of RF multiplier 106. Controlling the gain of RF multiplier 106 may compensate for the PVT variations. The replica path 104 may include an RF multiplier 110 that is similar or nearly identical to RF multiplier 106 of the main path 102 and a TIA 112 that functions similarly or nearly identically to the TIA 108 of the main path 102. Accordingly, the response of the replica path 104 sub-circuit may be similar or nearly identical with the response of the main path 102. Since the replica path is nearly identical to the main path 102, the gain variation of the replica path 104 may be similar to the gain variation of the main path 102.

In an example embodiment, a known DC voltage DCIN is input to the RF multiplier 110 and compared with the output of the TIA 112 at voltage regulator 114. Since there is a known relationship between the gain at 0 frequency (or DC) and the gain at the operating RF frequency of the RF squarer circuit, a DC voltage may be used for the replica path 104 biasing. The gain of the replica path, and therefore the gain of the main path as well, may be: gain*$Vdc^2$=Vdc (where Vdc=the value of DCIN), and gain=1/Vdc. If the known input voltage DCIN does not change over PVT, the gain of the multiplier may also not vary, or the variation may be reduced.

In an example embodiment, the known input voltage DCIN may be provided by a biasing circuit. For example, a biasing circuit may include a particular current and a resistor, where voltage=resistance×current. The current I may be provided from a so-called bandgap circuit that may generate a constant voltage independent of PVT. The input DC voltage DCIN may therefore be constant or relatively constant over PVT and the gain of the RF multipliers 106, 110 may be constant or relatively constant over PVT, which may provide for an RF squarer circuit 100 that performs relatively stable over PVT.

The voltage regulator 114 may provide VREG to control the gain of both RF multipliers 106 and 110. Controlling the gain of RF multiplier 106 may improve the performance of the RF squarer circuit 100, for example by improving the linearity of the RF multiplier 102. Otherwise, the circuit may become less linear at lower temperature and may have higher gain at lower temperatures. At higher temperatures, the circuit may otherwise become more linear at higher temperature but with decreased gain. Increasing the amount of degeneration may decrease the gain but increases the linearity. In an example embodiment, degeneration may compensate for gain variations as temperature decreases while also compensating for the loss of linearity. The same may be true for process variations where low temperature may be replaced with "fast corner" and high temperature may be replaced with "slow corner".

Figure 2:
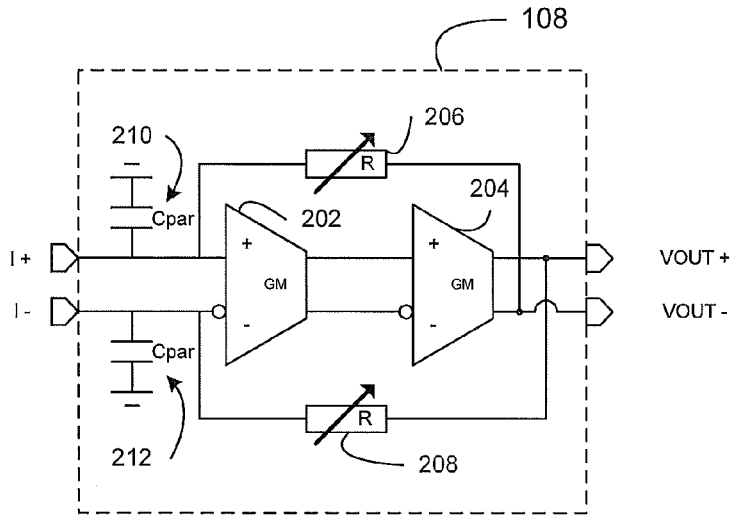
FIG. 2 illustrates an example embodiment of a variable gain transimpedance amplifier (TIA).

FIG. 2 illustrates an example embodiment of the TIA 108 of the main path 102 of the RF squarer circuit 100 of FIG. 1. TIA 108 may include a two-stage arrangement of transconductance amplifiers 202 and 204 (voltage controlled current sources (VCCS)). TIA 108 may also include variable resistors 206, 208, arranged between the +input of transconductance amplifier 202 and the −output of transconductance amplifier 204, and between −input of transconductance amplifier 202 and the +output of transconductance amplifier 204, respectively. In an example embodiment, parasitic capacitances 210, 212 may also be present between the + and − current inputs (I+, I−) to the TIA 108. The effect of the parasitic capacitances 210, 212 may be reduced by the second transconductance stage and its associated gain peaking.

In an example embodiment, changing the resistor value changes the gain of the TIA: Vout=R(variable)*current at input. A control signal from a controller may adjust the resistance of variable resistors 206, 208. The controller may be a microcontroller, firmware, for example firmware on the chip, or any other controller with logic to adjust the variable resistance values according to system needs. The logic may be in the form of electronic instructions stored in memory or firmware on the chip with the appropriate logic pre-programmed for control of the variable resistors 206, 208 according to system needs in a particular embodiment or application.

In an example embodiment, the TIA 112 of the replica path 104 may also be similar to the TIA 108 of the main path 102. In alternate embodiments, however, the TIA 112 of replica path 104 may have a different structure or design, provided that it performs the function of a TIA. TIA 112 may be a conventional TIA and may be a TIA similar to the one illustrated in FIG. 2, except for the two-stage cascade of amplifiers. TIA 112, for example, may use only variable resistances. Since the replica path 104 may not need to drive any low impedance load like the main path 102, an active circuit may not be needed. Accordingly, the TIA 112 may require only the resistances to transform the current into a voltage.

FIG. 3 illustrates an example embodiment of the RF multipliers 106 and 110 illustrated in FIG. 1. In an example embodiment, the gain of multipliers 106 and 110 may be regulated using a degeneration transistor 410*a*, 410*b* in parallel with a signal transistor 420*a*, 420*b*. A suitable RF multiplier 106, 110 may be based on the "Gilbert Cell" architecture. In an example embodiment, a more-conventional Gilbert Cell may include an arrangement similar to transistors 420*a,b*, 430*a,b* and 440*a,b* shown in FIG. 3, but without transistors 410*a,b*.

In an example embodiment, RF multiplier 106, 110 may include transistors 410*a* and 410*b*, the degeneration transistors, placed in parallel with transistors 420*a* and 420*b*, the signal transistors. Placing the transistors 410*a* and 410*b* in parallel with transistors 420*a* and 420*b* may provide control of the gain of RF multiplier 106, 110.

In an example embodiment, RF multiplier 106, 110 may be a current-mode or current output RF multiplier. The current-mode RF multipliers 106, 110 may include two current sources 416 to provide a DC quiescent current. The current sources 416 may provide a current that may be drained at current source 450. In an example embodiment, draining the current at current source 450 may provide that no systematic current flows in/out of I+/−. Voltage drain-drain VDD is the power supply for the current-mode RF multiplier 106. Current source 450 may be located where it might be located in other Gilbert Cell arrangements. Current source 450 may provide for DC current for setting the operating point.

In an example embodiment, transistors 420*a* and 420*b* may be controlled by an input voltage VREG provided, for example, by the voltage controlled regulation amplifier 114 of the replica path 104 (see FIG. 1). Input voltage VREG may control the amount of current flowing in transistors 410*a* and 410*b*, and therefore the amount of current flowing in transistors 420*a* and 420*b*. In an example embodiment, when VREG is increased, the current flowing in 410*a* and 410*b* is increased and the current flowing in 420*a* and 420*b* is decreased. The transconductance (Gm) of transistors 420*a* and 420*b* may therefore be decreased. Decreasing VREG may increase the transconductance (Gm) of transistors 420*a* and 420*b*. In an example embodiment, the relation between VREG and the gain of 3 may be linear, even if transistors 420*a* and 420*b* is turned completely ON or OFF.

In an example embodiment, changing the current flowing in a MOS transistor changes the transconductance (Gm) of the MOS transistor. Since the gain of a circuit is proportional to Gm*R, increasing VREG decreases the gain of the multiplier and decreasing VREG increases the gain.

Although Gilbert Cells without degeneration transistors 410*a* and 410*b* and with voltage output and amplification stage might otherwise be used, such Gilbert Cells may have drawbacks. Methods of varying the gain of a Gilbert Cell by using a degeneration variable resistor R connected between the current source 450 and the transistors 420*a* and 420*b*, for example, may "degenerate" the transistors 420*a* and 420*b* by reducing their transconductance (Gm), where transconductance is the parameter Gm in following equation: Ids=Gm*Vgs (d=drain, s=source, g=gate. In other words each MOS device may be considered as a transconductance when the input signal is applied to g or s). Such methods may have at least two disadvantages, namely an increase in noise created by the resistor R, and a reduction in dynamic range when R is increased. Moreover, if R becomes too large, the current source may be "crushed" and may not work as a constant current source anymore. Such methods may also be switched off completely. When this happens, a multiplier may have a non-linear behavior, making the design of the regulation circuit very difficult. In an example embodiment, a current-mode RF multiplier with degeneration transistors in parallel with signal transistors may avoid the drawbacks of such other options.

Figure 4:
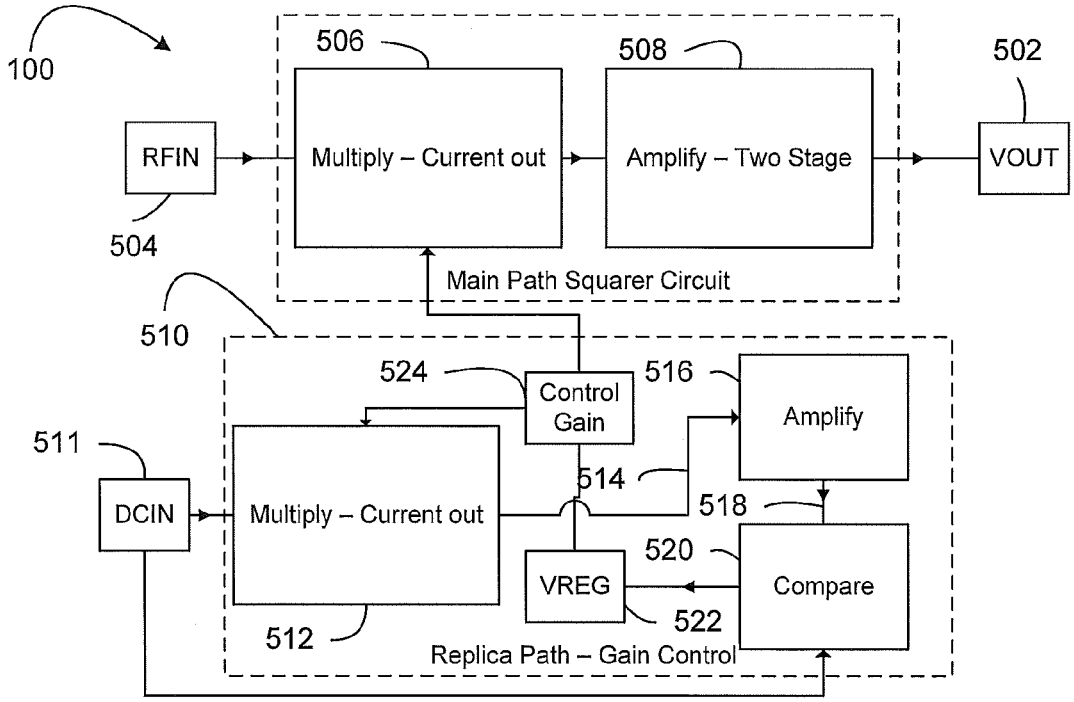

FIG. 4 illustrates an example embodiment of a method 500 of processing an RF signal RFIN to provide an output voltage VOUT 502 representative of the amplitude of an input RF signal RFIN (FIG. 1) squared. In an example embodiment, an RF signal may be provided 504 as input for a current-mode RF multiplier 106 (FIG. 1). The RF multiplier may multiply the RF input 506 and feed an output current 508 to a two-stage transimpedance amplifier (TIA) 108 (FIG. 1). The TIA 108 may output 502 the output voltage VOUT. The output voltage VOUT may behave according to the equation:

$$(A \cdot \mathrm{Cos}(\omega))^2 = \frac{A^2}{2}(1 + \mathrm{Cos}(2\omega)),$$

where A is the amplitude of RFIN and to is the angular frequency of RFIN. Input RF signal RFIN may be received 504 at a main path 102 of an RF squarer circuit 100 (FIG. 1) and the output VOUT may be output from the main path 102 of the RF squarer circuit 100.

In an example embodiment, the method 500 of processing an RF signal may also include controlling the gain of the RF multiplier of the main path by a replica path sub-circuit 510. Controlling the gain with a replica path sub-circuit 510 may include providing a known DC voltage DCIN 511 as input to the replica path 104 of RF squarer circuit 100 (FIG. 1). For example, known DC voltage DCIN may be input to a second RF multiplier 110 (FIG. 1). The second RF multiplier 110 may multiply DCIN 512 and feed an output current 514 to a second transimpedance amplifier (TIA). The second RF multiplier may be substantially similar or identical to the first RF multiplier, as discussed above with respect to FIG. 3. The second transimpedance amplifier (TIA) may be substantially similar to the first TIA, or may differ in that it does not include a two-stage cascade of transconductance amplifiers as shown in FIG. 2 and discussed above, with respect to FIG. 2. The second TIA may amplify 516 the input current and provide an output voltage 518 to a voltage regulator. The voltage regulator may compare 520 the known input voltage DCIN or any other DC voltage to the output voltage of the second TIA and provide a relating voltage VREG 522.

In an example embodiment, the output voltage VREG from the voltage regulator may be fed to the RF multipliers of both the main and replica path to control the gain 524 of the RF multipliers. The control may be accomplished as discussed above, with respect to FIGS. 1 through 3.

In an example embodiment, RF squarer circuit 100 (FIG. 1) may be used as circuit architecture for various signal processor applications, for example applications in the Gigahertz range. RF squarer circuit 100 may be suitable for use in a broad range of mixed-signal designs and applications.

Specific examples of applications for which RF squarer 100 may be suitable include, for example, use as a power detector. An RF squarer 100 used as a power detector may be used, for example, in conjunction with an analog predistorter for linearization of RF power amplifiers. In an example embodiment, an envelope detector may be designed based on similar RF squarer architecture. RF squarer 100 may also be suitable for use in any analog signal processing circuit.

Although embodiments of the invention has been shown and depicted, various other changes, additions and omissions in the form and detail thereof may be made therein without departing from the intent and scope of this invention. The appended claims encompass all such changes and modifications as fall within the true spirit and scope of this invention.

What is claimed is:

1. An RF squarer circuit, comprising:

a first RF multiplier, the first RF multiplier receiving an RF input signal RFIN and providing a first output current; and a first variable gain transimpedance amplifier (TIA), the first TIA receiving as an input, the first output current; wherein the first TIA provides an output voltage VOUT;

a second RE multiplier;

a second variable transimpedance amplifier (TIA); and a voltage regulator; wherein the second RF multiplier receives a known input DC voltage (DCIN) and feeds a second output current to the second TIA, and the second TIA provides a second output voltage to the voltage regulator, and the voltage regulator providing an output regulator voltage (VREG) to the first and second RF multipliers.

2. The RE squarer circuit of claim 1, wherein the VOUT behaves in accordance with the equation:

$$(A \cdot \mathrm{Cos}(\omega))^2 = \frac{A^2}{2}(1 + \mathrm{Cos}(2\omega)),$$

where A is an amplitude of REIN and ω is an angular frequency of RFIN.

3. The RF squarer circuit of claim 1, wherein the first RF multiplier is a current-mode RE multiplier.

4. The RF squarer circuit of claim 3, wherein the first RF multiplier includes a Gilbert Cell with a degeneration transistor in parallel with a signal transistor.

5. The RF squarer circuit of claim 1, wherein the first variable gain transimpedance amplifier (TIA) includes a two-stage amplifier.

6. The RF squarer circuit of claim 5, wherein the two-stage amplifier includes a cascade of two transconductance amplifiers.

7. The RF squarer circuit of claim 1, wherein the first RF multiplier and the first TIA for a main path and the second RF multiplier, second TIA, and voltage regular form a replica path.

8. The RF squarer circuit of claim 1, wherein the first and second RF multipliers are current-mode RF multiplier; and wherein the first variable gain transimpedance amplifier (TIA) includes a two-stage amplifier, the two-stage amplifier including a cascade of two trans conductance amplifiers.

9. The RF squarer circuit of claim 1, wherein the first and second RF multipliers each include a Gilbert Cell with a degeneration transistor in parallel with a signal transistor; and wherein DCIN is relatively constant over process, temperature and voltage (PVT) and VREG controls a gain of each of the RF multipliers to be relatively constant over PVT.

10. The RF squarer circuit of claim 1, wherein:

the VOUT behaves in accordance with the equation:

$$(A \cdot \mathrm{Cos}(\omega))^2 = \frac{A^2}{2}(1 + \mathrm{Cos}(2\omega)),$$

where A is an amplitude of RFIN and ω is an angular frequency of RFIN.

11. An RF squarer circuit, comprising:

a main path for receiving an input RF signal (RFIN) and providing an output voltage (VOUT) representative of an amplitude of RFIN squared;

a replica path for providing a control voltage (VREG) to control a gain of the main path, wherein the replica path receives a known input DC voltage (DCIN) that is relatively constant over process, temperature and voltage (PVT) and VREG provides for stable control of the gain of the main path over PVT.

12. The RF squarer circuit of claim 11, wherein:

the main path comprises a first current-mode RF multiplier and a first transimpedance amplifier, the first current-mode RF multiplier receives RFIN and feeds the first TIA with a first output current and the first output TIA provides VOUT.

13. The RF squarer circuit of claim 11, wherein:

the replica path comprises a second current-mode RF multiplier, a second transimpedance amplifier (TIA) and a voltage regulator, the second current-mode RF multiplier receiving DCIN and feeding a second output current to the second TIA, and the second TIA provides a second output voltage, and the voltage regulator compares the second output voltage with DCIN and provides VREG responsive to the second output voltage and DCIN.

14. The RF squarer circuit of claim 12, wherein:

the main path comprises a first current-mode RF multiplier and a first transimpedance amplifier, the first current-mode RF multiplier receives RFIN and feeds the first TIA with a first output current and the first output TIA provides VOUT; and wherein the replica path comprises a second current-mode RF multiplier, a second transimpedance amplifier (TIA) and a voltage regulator, the second current-mode RF multiplier receiving DCIN and feeding a second output current to the second TIA, and the second TIA provides a second output voltage, and the voltage regulator compares the second output voltage with DCIN and provides VREG responsive to the second output voltage and DCIN.

15. The RF squarer circuit of claim 14, wherein the first transimpedance amplifier (TIA) includes a two-stage amplifier, the two-stage amplifier including a cascade of two transconductance amplifiers, the first and second RF multipliers each include a Gilbert Cell with a degeneration transistor in parallel with a signal transistor.

16. A method of squaring an RF input signal, comprising:

multiplying the RF input signal in a first current-mode RF multiplier;

feeding a first output current from the current-mode RF multiplier to a first two-stage transimpedance amplifier (TIA);

amplifying the first output current from the current-mode RF multiplier in the first two-stage TIA and providing an output voltage VOUT; wherein VOUT is representative of a square of an amplitude of the RF input signal;

controlling a gain of the first current-mode RF multiplier in a replica, wherein controlling the gain of the first current-mode RF multiplier in a replica path comprises:

providing a known input DC voltage in (DCIN), wherein DCIN is relatively constant over process, temperature and voltage (PVC);

multiplying DCIN in a second current-mode RF multiplier and providing a second output current to a second transimpedance voltage amplifier (TIA);

comparing a second output voltage of the second TIA with DCIN at a voltage regulator;

providing an output regulation voltage (VREG); and feeding VREG to the first current-mode RF multiplier to control the gain of the first current-mode RF multiplier.

17. The method of claim 16, wherein the first current-mode RF multiplier includes a Gilbert Cell with a degeneration transistor in parallel with a signal transistor.

18. The method of claim 16, wherein the first two-stage TIA includes a cascade of two transconductance amplifiers.

19. The method of claim 16, wherein the first current-mode RF multiplier includes a Gilbert Cell with a degeneration transistor in parallel with a signal transistor.

20. The method of claim 16, wherein the first two-stage TIA includes a cascade of two transconductance amplifiers and the first current-mode RF multiplier includes a Gilbert Cell with a degeneration transistor in parallel with a signal transistor.

* * * * *